United States Patent [19]

Jackson

[11] 4,004,048

[45] * Jan. 18, 1977

[54] RAPID FIXATION OF AGENTS ON FLEXIBLE SUBSTRATES

[75] Inventor: Harold L. Jackson, Hockessin, Del.

[73] Assignee: E. I. Du Pont de Nemours and Company, Wilmington, Del.

[ * ] Notice: The portion of the term of this patent subsequent to May 25, 1993, has been disclaimed.

[22] Filed: May 28, 1975

[21] Appl. No.: 581,571

Related U.S. Application Data

[63] Continuation-in-part of Ser. No. 486,115, July 5, 1974, Pat. No. 3,958,934, which is a continuation-in-part of Ser. No. 367,333, June 5, 1973, abandoned.

[52] U.S. Cl. ..... 427/158; 427/160; 427/335; 427/336; 427/337; 427/342

[51] Int. Cl.[2] ..... D06M 13/08; D06M 13/36; D06M 13/18

[58] Field of Search ..... 427/158, 160, 335, 336, 427/337, 342

[56] References Cited

UNITED STATES PATENTS 3,784,355 1/1974 Fielding ..... 427/335 X

*Primary Examiner*—James R. Hoffman

[57] ABSTRACT

Non-aqueous process for improving a functional property of flexible, natural and synthetic, organic polymeric substrates, such as textiles, film and paper, for example, polyethylene terephthalate or cotton fabric, by applying thereto an agent other than a dye, which agent is capable of imparting the desired improved functional property to the substrate, which process comprises:

1. applying said agent to the substrate from a liquid medium;
2. optionally, drying the substrate to remove the liquid while substantially retaining the agent on the substrate; and
3. contacting the agent-treated substrate with a fluorocarbon fluid at a temperature and for a time sufficient to effect fixation of the agent on the substrate, said fluorocarbon having an atmospheric pressure boiling point of at least 25° C., a fluorine to carbon atom ratio of at least 1.5 and a solubility parameter of not greater than 7.0 and being selected from the group consisting of saturated fluorocarbons and perfluorotrialkyl and perfluorotetraalkyl ethylenes.

19 Claims, No Drawings

RAPID FIXATION OF AGENTS ON FLEXIBLE SUBSTRATES

CROSS-REFERENCE TO RELATED APPLICATIONS

This application is a continuation-in-part of application Ser. No. 486,115 filed July 5, 1974, and now U.S. Pat. No. 3958934, the latter being a continuation-in-part of application Ser. No. 367,333 filed June 5, 1973 and abandoned July 5, 1974.

BACKGROUND OF THE INVENTION

1. Field of the Invention

This invention relates to a non-aqueous process for fixing a functional property-improving agent on a flexible, organic polymeric substrate.

2. Description of the Prior Art

Agents which are conventionally applied to flexible, natural or synthetic, organic polymeric substrates to improve one or more functional properties thereof include dyes, permanent press (durable press) and anti-crease resins, oil- and water repellent resins and chemicals, fluorescent brightening agents, fiber stabilization chemicals, softeners, ultraviolet light screening agents, fire retardant chemicals, bacteriostats, fungistats and biocides. In prior art processes, such agents are generally applied to such flexible substrates, such as natural and synthetic fibers, films and paper, from aqueous media and, after drying, are heated in air or in the vapors of an organic liquid to fix them on the substrates. For example, Cashen et al. in Textile Solvent Technology Update 1973, American Association of Textile Chemists and Colorists Symposium 1973, pp. 79–90, disclose the curing of methylolamines in the production of dimethylol ethylene urea durable press finishes on cotton using the saturated vapors of a number of alcohols and chlorocarbons. Alcohols may give poor yields of cured resin because of the competing reaction with the methylolamines and/or because of the solubility of the resin in the alcohol, thus dissolving the resin from the substrate. Hot water, hot air and steam have been similarly employed to fix agents on substrates.

SUMMARY OF THE INVENTION

Fixing and fixation, as the terms are used in this specification, are intended to include not only diffusion of the agent into the substrate but also interaction of agent with itself (crosslinking) or the substrate, the interaction commonly being referred to as curing. Furthermore, it is to be understood that reference to fixing or fixation of an agent on a substrate is intended to include not only surface fixation but also sub-surface fixation, that is, fixation wherein the agent has diffused into the substrate. Although fixing, in the sense of diffusion of a material into a substrate, is best known in connection with disperse dyeing, a similar phenomenon occurs with certain non-dye agents. It is known that the rate of diffusion is exponential with temperature. Finally, as the term is used in this specification, a fluid is intended to include both liquids and vapors or gases.

In summary, this invention resides in a non-aqueous process for improving a functional property of flexible, natural and synthetic, organic, polymeric substrates, such as textiles, films and paper, for example, polyethylene terephthalate or cotton fabric, by applying thereto an agent other than a dye, which agent is capable of imparting the desired improved functional property to the substrate, which process comprises:

1. applying said agent to the substrate from a liquid medium:
2. optionally, drying the substrate to remove the liquid while substantially retaining the agent on the substrate; and
3. contacting the agent-treated substrate with a fluorocarbon fluid at a temperature and for a time sufficient to effect fixation of the agent on the substrate, said fluorocarbon having an atmospheric pressure boiling point of at least 25° C., a fluorine to carbon atom ratio of at least 1.5 and a solubility parameter of not greater than 7.0 and being selected from the group consisting of saturated fluorocarbons and perfluorotrialkyl and perfluorotetraalkyl ethylenes. When the substrate is an organic polymer having a glass transition temperature (Tg) and diffusion of the agent into the polymer is required, heating preferably is carried out at a temperature above such Tg. It is preferred to employ a saturated fluorocarbon fluid having a boiling point of at least 125° C. and a solubility parameter of not greater than 6.5.

DETAILED DESCRIPTION OF THE INVENTION

This invention, as summarized above, is directed to a process for treating natural and synthetic organic polymeric substrates, especially those in the form of films, textile fabrics and paper. In this process the desired treating agent is first applied to the substrate, for example, by spraying or padding, and the treated substrate, optionally dried, is then passed through a fluorocarbon fluid at a temperature and for sufficient time to fix the agent on the substrate. If deemed necessary after fixing, the substrate can be scoured. If the substrate is a polymer having a glass transition temperature (Tg) and the agent requires diffusion into the polymer, the fixing step is carried out at a temperature which is above the Tg. Glass transition temperature, particularly as it relates to organic polymers, is well known in the art. It also is known that the glass transition temperature, particularly as to synthetic organic polymers, may vary with the chemical composition and the past history of the polymer. For example, polyethylene terephthalate has a glass transition temperature of 67° C. in the amorphous condition, 81° C. in the crystalline condition and 125° C. when crystalline and oriented. Polyamides and most other polymers behave similarly. It is preferable, therefore, to carry out this stage of the process at a temperature higher than the highest glass transition temperature expected for such a polymer in question, for example, above 125° C. for polyethylene terephthalate. The rate of fixation varies with temperature, higher temperatures causing more rapid fixation. Useful organic polymeric substrate materials include acid modified polyacrylics (modacrylics), polyesters, polyamides and cellulose acetates such as cellulose diacetate and cellulose triacetate. Polyesters, such as polyethylene terephthalate, and polyamides, such as 66 nylon, are especially useful in the process of this invention. The polymeric substrate can be a mixture of natural and synthetic polymers, for example, blends of polyester and other materials, such as cotton or wool, the latter also being examples of natural, organic polymeric substrates which, by themselves, are useful herein.

As indicated above, the first step in the process of this invention is the application, for example, by spraying or padding, of the treating agent onto the substrate. The nature of the spraying or padding system is critical only to the extent that it must be suitable for the form and nature of the substrate being treated. For example, padding can be effected by application of a solvent-agent solution, a solubilized agent composition, a solvent-agent dispersion of a solvent-aqueous agent emulsion; aqueous padding methods, employing an emulsion of the agent, also can be used. Spraying or padding with aqueous emulsions or dispersions of agents employing conventional equipment is well known in the art. In padding operations the degree of loading of agent usually is controlled by adjustment of squeeze rolls or equivalent equipment. In spraying the loading is controlled by adjustment of spray volume and substrate travel rate. Preparation of the agent spray or pad bath varies with the agent being applied; the art discloses numerous suitable methods for preparing baths from all types of agents.

Subsequent to application of the agent, for example, by spraying or padding, a drying step (optional) may be desirable. Particularly when aqueous systems are used, drying may be desirable to remove excess water prior to contacting the agent-containing substrate with the fluorocarbon fluid, but even then, drying is not essential since it will occur during the next step of the process. Drying prior to fixation may also be desirable to remove strong application solvents, such as dimethylformamide.

The next step of the process involves contacting the polymeric substrate, having treating agent applied thereto, with the fluorocarbon fluid at a temperature and for a time sufficient to effect fixation of the agent on the substrate. If the substrate is an organic polymer having a transition temperature and the treating agent must be diffused into the substrate, heating preferably is carried out above the glass transition temperature. This contacting step of the process has three variations which require somewhat different manipulations and equipment: (1) treatment with fluorocarbon liquid (2) treatment with fluorocarbon saturated vapor; or (3) treatment with superheated fluorocarbon vapor. The variation chosen will depend on the fluorocarbon selected and the fixation temperature necessary. Continuous fixation equipment wherein the treated fabric is passed through the bath over a series of rollers, in a fashion much like a pad bath, can be fabricated readily. Descriptions of fixation equipment which is useful herein are available in the prior art.

The process of the invention usually provides higher yields of agents applied to and fixed on the flexible substrates, in sorter exposure times, than can be achieved by most prior art methods. It generally is recognized that the yield of an agent found on a substrate following a fixing process depends, in part, on the solubility of the agent in the medium used to heat the substrate to effect fixing. In carrying out the process of this invention the heat transfer materials selected from the operable fluorocarbon fluids, as defined below, do not dissolve the agents being applied to the substrates.

The fluorocarbon fluid employed herein must meet certain requirements. It must have an atmospheric pressure boiling point of at least about 25° C. Preferably, to minimize both energy requirements and diffusional losses from equipment during operation of the invention process, it should have a boiling point of at least 125° C. The fluorocarbon must have a fluorine to carbon atom ratio of at least 1.5, that is, there must be at least 1.5 fluorine atoms per carbon atom in the molecule. Preferably, the fluorine to carbon atom ratio is at least 2.0. The remaining constituents of the molecule are usually hydrogen atoms, other halogens, particularly chlorine atoms, or hetero-atoms, in particular, ether oxygen or tertiary amine nitrogen atoms. The fluorocarbon must have a solubility parameter (as hereinafter defined) of not greater than 7.0. This is to ensure that the agent is sufficiently insoluble in the fluorocarbon to have a partition function which favors the polymer rather than the fixation medium. When the solubility parameter is no greater than 7.0, substantially none of the fixation medium is imbibed by the polymer during agent fixation. In contrast, with a medium such as tetrachloroethylene, with a parameter of 9.4, polyester will imbibe 3–10% by weight of tetrachloroethylene. Preferably, the solubility parameter of the normally liquid fluorocarbon employed herein is no greater than 6.5

There are a number of known useful fluorocarbons having the aforementioned properties. These include saturated and unsaturated aliphatic and cycloaliphatic fluorocarbons, the unsaturated fluorocarbons being more fully discussed hereinafter. Operable fluorocarbons include the following, with the solubility parameters being given in parentheses if they have been measured or calculated: perfluoroaliphatic and perfluorocycloaliphatic hydrocarbons, such as perfluoro(1-methyldecalin) (6.4), perfluorophenanthrene, perfluorononane (5.8) and perfluoroundecane (5.6); perfluorokerosene constitutents, such as perfluorotetradecane (5.6) and perfluorohexadecane (5.5); perfluoroethers including the hexafluoropropylene oxide polymers having molecular weights as high as several thousand, such as $F[CF(CF_3)CF_2O]_nCHFCF_3$ (5.5-6.5) and $F[CF(CF_3)CF_2O]_nCF_2CF_3$, $n$ being an integer, preferably 3–9; and perfluorotrialkylamines, such as perfluorotributylamine. Among the perfluoroalkanes, those having 9–16 carbon atoms are preferred. Also included are chlorofluoroalkanes, such as 1-chloroperfluorodecane. The above listing is not intended to be complete. Any fluorocarbon or mixture of fluorocarbons having the required properties is meant to be included. Fluorocarbons which are not useful herein because they boil below 25° C. and/or have solubility parameters which are too high are tetrafluoromethane, chlorotrifluoromethane, dichlorodifluoromethane, chlorodifluoromethane, hexafluoroethane, chloropentafluoroethane, 1,1,2-trichloro-1,2,2-trifluoroethane (solubility parameter 7.2) and octafluorocyclobutane. In general, unsaturated fluorocarbons, that is, fluorocarbons containing a

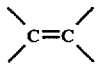

moiety, are excluded or undesirable because of their reactivities, especially with free amino groups, such as often are present in treating agents, and because they often are highly toxic. However, it has been found that such unsaturated fluorocarbons which have three or four perfluoroalkyl groups of 1–10 carbon atoms, preferably 1–3 carbon atoms, attached to the

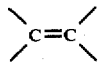

moiety are useful herein because they are substantially non-reactive.

Suitable fluorocarbons can be selected according to the well known Hildebrand solubility parameter, as applied to the fluorocarbon, the agent and the substrate; this is discussed, for example, in "The Solubility of Nonelectrolytes" by Joel H. Hildebrand and Robert L. Scott, 3rd edition, Reinhold Publishing Corp., New York, New York, 1950, and by H. Burrell in Journal of Paint Technology 27, 726 (1955). The theory underlying the solubility parameter is that materials of similar solubility parameter tend to be miscible with each other whereas those with widely different solubility parameters are not miscible with each other. The solubility parameter of the material can be calculated from the well known equation $$\delta = \left[\frac{\Delta H - RT}{V}\right]^{1/2}$$

wherein δ is the solubility parameter, ΔH is the molar heat of vaporization, R is the gas costant, T is the absolute temperature and V is the molar volume, all in consistent units. Although solubility parameters may be reported as $(\text{cal./cc.})^{1/2}$, the units generally are not specified, as may be noted from Table 1 which includes operable fluorocarbons, and their solubility parameters, such as may be found in the aforesaid text by Hildebrand and Scott. ΔH, if not already known, can readily be determined by commonly known methods. V, if not known, can easily be calculated from the density of the compound by dividing it into the molecular weight. The substrate treating agents employed in the process of this invention generally have polar groups and, therefore, have relatively high solubility parameters (at least about 10). Similarly, most organic polymeric substrates which are treated by the process of this invention have solubility parameters of at least 10. More specifically, the treating agent should dissolve in the polymeric substrate and not redistribute into the fluorocarbon. To achieve this, the solubility parameter of the fluorocarbon must not be greater than 7.0.

TABLE 1

| Fluid | Solubility Parameter |
|---|---|
| $CF_3(CF_2)_9CF_3$ | 5.6 |
| $C_3F_7O(CF(CF_3)CF_2O)_nCFHCF_3$ wherein n = 1, 2, 3, 4, 5... (preferred 3–9) | 5.5 –6.5 |
| 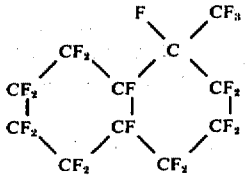 | 6.4 |
| $(C_4F_9)_3N$ | ~6.0 |
| $CF_2{-}CF{-}CF_3$ / $CF_2{-}CF{-}CF_3$, and isomer | 5.6 |

TABLE 1-continued

| Fluid | Solubility Parameter |
|---|---|
| $CF_3(CF_2)_7CF_3$ | 5.8 |
| $CF_3CCl_2CF_3$ | 6.3 |
| $C_3F_7CFHCF_3$ | ~6.5 |
| $CF_3CCl_2CClF_2$ | 7.0 |
| 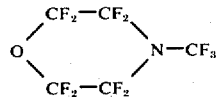 | 6.5 |
| $CF_3CFClCFClCF_3$ | 7.0 |
| 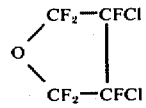 | 7.0 |

Fluorocarbons which are useful primarily in liquid phase fixation systems operating at atmospheric pressure are those with atmospheric pressure boiling temperatures above about 200° C. and include, with the solubility parameters shown in parentheses; the hexafluoropropylene oxide polymers of the formulas $F[CF(CF_3)CF_2O]_nCHFCF_3$ (5.5 – 6.5) and $F[CF(CF_3)CF_2O]_nCF_2CF_3$ (about 5.5) wherein *n* is an integer to such a value as to provide molecular weights as high as several thousand, but preferably 3–9, perfluorokerosene constituents, such as perfluorotetradecane and higher boiling perfluoroalkanes, and chloroperfluoroalkanes, such as 1-chloroperfluorododecane. When using the fluorocarbons as liquids, a bath of the liquid is heated to the desired fixation temperature and the padded polymeric substrate is immersed or passed through the heated liquid for the desired length of time. Any suitable apparatus can be used, for example, conventional prior art equipment, such as that shown in U.S. Pat. No. 3,667,898. When the fluorocarbon is used as a liquid, the same procedures are used as described above for the padding operation.

Fluorocarbons which are useful as saturated vapors, that is, vapors in thermal equilibrium with the boiling liquid, as superheated vapors or as liquids include, with the solubility parameters shown in parentheses: the hexafluoropropylene oxides of the formulas $F[CF(CF_3)CF_2O]_3CHFCF_3$ (about 6.0) and $F[CF(CF_3)CF_2O]_3CF_2CF_3$ (about 6.0), both having a b.p. of about 152° C.; perfluoro(1-methyldecalin), b.p. of about 160° C.; perfluoro-1,3,5-trimethylcyclohexane (about 5.5), b.p. 125° C.; chloroperfluorooctane, b.p. 132°–153° C. 1-chloroperfluorodecane, b.p. 169°–171° C.; perfluorotributylamine (about 6.0), b.p. 180° C; perfluorodimethylcyclobutane (5.6), b.p. 45° C.; mixtures of perfluorobutyltetrahydrofuran and perfluoropropyltetrahydropyran, b.p. 99°–107° C.

When the fluorocarbon fluid is used as a saturated vapor, the padded polymeric substrate is immersed in the vapors of the boiling liquid. Such a system requires means (well known in the art) for condensing the vapors to prevent their escape from the system. When the fluorocarbon fluid is employed in the superheated condition, it is substantially more efficient to employ a fluid having a boiling temperature close to the use temperature.

The preferred fluorocarbon fluids having a boiling point of at least 125° C. have a relatively high molecular weight. Such fluids of high boiling temperatures and high molecular weight maximize energy utilization. Fluids of high boiling temperature and molecular weight are more easily confined in devices for carrying out the invention process. They are more easily condensed and diffusional losses are substantially reduced below those characteristic of fluids of lower molecular weight and boiling termperature. With increasing molecular weight the fluorocarbon fluid exhibits less tendency to attack gaskets and other organic materials of construction; the solubility parameter decreases with molecular weight. These considerations provide options not available when using prior art fluids; this leads to simpler devices for carrying out the process of the invention.

The use of the aforesaid materials in the form of superheated vapors requires suitable equipment for boiling, superheating the vapor produced, contacting the polymeric substrate with such vapor and condensing the spent vapor. Such equipment is known in the prior art, for example, that already cited above. To provide a practical process, from an energy standpoint, employing such equipment, however, it is necessary that the fluorocarbon fluid have the properties listed above.

If fixation of agent is not complete, if residual fluorocarbon remains on the substrate or if an undesirable pad bath additive, such as a thickening agent, is retained on the substrate, scouring may be desirable. Either a solvent scour, for example, with trichlorotrifluoroethane, or an aqeous detergent scour can be used. When an entirely water free system is desired, a solvent scour is preferred. If fluorocarbon is retained on the substrate, a solvent scour with trichlorotrifluoroethane is preferred. If a water soluble material, such as an aqueous pad bath thickener, is retained by the substrate, an aqueous detergent scour is preferred. If the substrate is subjected to a solvent scour, recovery of the solvent by conventional means is desirable.

It has been found that, unlike perchloroethylene and other fixation agents disclosed in the prior art, the fluorocarbons employed herein are not imbibed by or absorbed in the polymeric substrate. As a result, it generally is not necessary to treat the substrate after agent fixation to remove the fluorocarbon. It also has been found that the process of this invention can be used to heat set fabrics. Heat set occurs when a fabric of a synthetic polymer is heated above its glass transition temperature, formed into a desired shape, for example, a crease, then cooled in the desired shape to below its glass transition temperature.

As already indicated, the process of the invention enables fixing to be carried out usually more quickly than most prior art methods employing, for example, hot air or tetrachloroethylene vapors. This is believed to be due to the superior heat transfer properties of the fluorocarbons employed herein. The superior heat transfer properties may be related to the higher densities and specific heats and the lower viscosities of the flurorcarbons employed herein as compared to conventional prior art fluids, such as tetrachloroethylene. Table 2 includes a comparison of such properties of $F(CF(CF_3)CF_2O)_nCHFCF_3$, a preferred class of fluorocarbons employed herein, and tetrachloroethylene.

TABLE 2

| | Liquid Density (g./cc., 25° C.) | Vapor Density (g./cc., 200° C | Specific Heat (Cal./g.) | Viscosity (Centipoise) |
|---|---|---|---|---|
| n = 3 | 1.72 | 0.016 | 0.24 | 2.2 (25° C.) |
| n = 4 | 1.76 | 0.020 | 0.24 | 4.1 (25° C.) |
| n = 5 | 1.79 | 0.024 | 0.24 | 7.0 (25° C.) |
| $CCl_2 = CCl_2$ | 1.63 (15° C.) | 0.004 | 0.21 | 87.6 (22.3° C.) |

The fluorocarbon fluids, as defined, are oxidatively highly stable and resistant to tar formation; moreover, their vapors tend to exclude air from contact with the treating agents and the substrates, thus protecting these materials from oxidation and tar formation.

The following examples demonstrate fixing of representative treating agents on natural and synthetic polymeric substrates.

EXAMPLE 1

This example demonstrates the fixing of an ultraviolet light screeining agent which is applied to a polyester substrate in acetone. A 5 wt. % solution of the ultraviolet light-screening agent of the formula

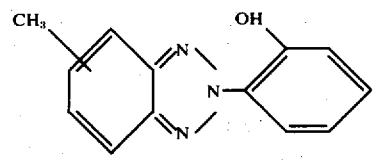

in acetone was padded onto polyethylene terephthalate double-knit fabric and dried. The fabric was divided into several parts and heat-treated at 200° C. for periods of 30, 60 and 120 seconds, respectively, in the following media:

1. superheated vapors of $F(CF(CF_3)CF_2O)_3CHFCF_3$,
2. superheated vapors of $CCl_2{=}CCl_2$, and
3. circulated hot air in an oven.

Samples were then scoured with acetone, to remove unfixed agent, and dried. The percent fixation yield was calculated by (a) weight gain of the fabric before curing, and (b) spectrophotometric analyses of dimethylformamide extracts of the samples. The results are shown in Table 3.

TABLE 3

| | Fixation Yield (%) | | |
|---|---|---|---|
| | 30 sec. | 60 sec. | 120 sec. |
| $F(CF(CF_3)CF_2O)_3CHFCF_3$ | 74 | 82 | 93 |
| $CCl_2 = CCl_2$ | 54 | 74 | 71 |
| Air | 61 | 68 | 68 |

From the table, it is evident that the fluorocarbon is superior at all exposure times to $CCl_2{=}CCl_2$ and air in fixation yield.

EXAMPLE 2

This example demonstrates the application to and fixation on polyethylene terephthalate of the bacteriostat of the formula

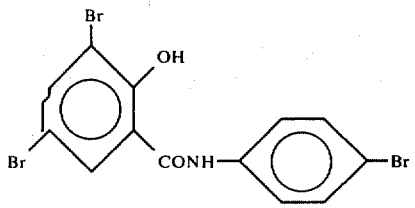

in a process similar to that of Example 1, with exposure to heat transfer media for 30 and 60 seconds at temperatures of 160°, 180°, and 200° C. The amount of agent fixed was determined by X-ray fluorescence. The results are shown in Table 4.

TABLE 4

| | Temp. (C°) | Fixation Yield (%) 30 sec. | 60 sec. |
|---|---|---|---|
| $F(CF(CF_3)CF_2O)_3CHFCF_3$ | 160 | 81 | 88 |
| $Cl_2C=CCl_2$ | 160 | 68 | 84 |
| Air | 160 | 55 | 69 |
| $F(CF(CF_3)CF_2O)_3CHFCF_3$ | 180 | 48 | 92 |
| $Cl_2C=CCl_2$ | 180 | 53 | 93 |
| Air | 180 | 48 | 68 |
| $F(CF(CF_3)CF_2O)_3CHFCF_3$ | 200 | 89 | 100 |
| $Cl_2C=CCl_2$ | 200 | 56 | 83 |
| Air | 200 | 55 | 53 |

As is seen, the fluorocarbon generally gives better fixation yields than do $CCl_2{=}CCl_2$ and air.

EXAMPLE 3

This example demonstrates substantially quantitative fixation on polyethylene terephthalate of the ultraviolet light-screening of the formula

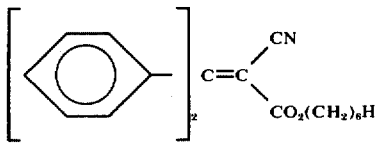

by the superheated vapors of various fluorocarbons which are operable in the invention. A 5 wt. % solution of the above agent in the azeotrope of 1,1,2-trichloro-1,2,2-trifluoroethane and ethanol was padded onto polyethylene terephthalate woven fabric and dried. Spectrophotometric analysis of a dimethylformamide extract of a sample of the fabric showed that 6.7 wt. % of the agent had been deposited on the surface of the fibers. Samples of the padded fabric were lowered into the superheated vapors of various fluorocarbons, at the temperatures indicated, for 60 seconds:

| | |
|---|---|
| perfluorotributylamine | 180° C. |
| mixture of perfluorobutyltetrahydrofuran and perfluoropropyltetrahydropyran | 160° C. |
| perfluorodimethylcyclobutane | 160° C. |

Thereafter, the samples were scoured in the azeotrope of 1,1,2-trichloro-1,2,2-trifluoroethane and ethanol to remove the agent which is very soluble in this azeotrope. Analyses of the fabric samples showed no substantial change from the original analysis, thus demonstrating that fixation was substantially complete.

EXAMPLE 4

This example, in two parts, demonstrates exhaust from and subsequent fixation by means of a liquid fluorocarbon of either a flame retardant or a mixture of a flame retardant and a dye.

A. one gram of a mixture of finely ground fire retardant of the formula

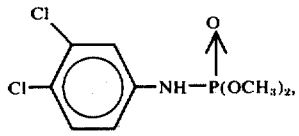

0.1 gram of the dispersant of the formula $F(CF(CF_3)CF_2O)_{10}CF(CF_3)COOH$ and 20 ml. of perfluoro(dimethylcyclobutane) were mixed by means of an ultrasonic probe. After dilution with 80 ml. of perfluoro(dimethylcyclobutane) the mixture was charged along with 2.65 g. of woven polyethylene terephthalate fabric to a 400 ml. stainless steel shaker tube. The tube was closed and, with shaking, heated to 150° C. for 60 minutes. The fibric was discharged from the cooled tube and rinsed successively with perfluoro(dimethylcyclobutane) and trichloroethylene. The dried fabric would not support a flame.

B. A 2.56 gram sample of polyethylene terephthalate fabric was charged along with 1 gram of the fire retardant of (A), 0.1 gram of the dispersant of (A), 26 grams of the disperse dye of the formula

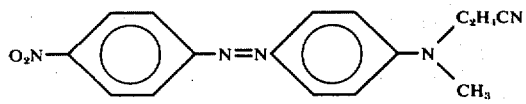

and 150 ml. of perfluoro(dimethylcyclobutane) to a stainless steel shaker tube. With shaking, the closed tube was heated to 150° C. for 60 minutes. The fabric was removed from the cooled tube, rinsed successively with trichloroethylene and acetone and dried. The fabric was dyed a deep orange and it would not support a flame.

EXAMPLE 5

This example demonstrates the fixing of a durable-press finish on cotton. The finish is a bis-methylolamine which, as is known, can, under acidic catalysis, homopolymerize (to form a resin) and crosslink cotton (by reaction with pendant hydroxyl groups). The finish of the formula

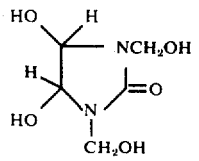

along with a zinc nitrate acidic catalyst, was padded onto cotton fabric. After drying, the fabric was divided into several parts and the parts were heated at various temperatures by exposure either to the superheated vapors of either a fluorocarbon which is operable in the invention or tetrachloroethylene or to hot air in a forced draft oven, as is known in the art. The results are shown in Table 5 in terms of the weight percent of nitrogen found in or on the fabric. The average of nitrogen analyses on six samples of treated cloth before curing was 1.02 wt. %.

TABLE 5

| | Temp. (° C.) | Nitrogen (wt. %) 30 sec. | 60 sec. | 120 sec. | 180 sec. |
|---|---|---|---|---|---|
| $F(CF(CF_3)CF_2O)_3CHFCF_3$ | 180 | 0.75 | 0.84 | 0.84 | 0.85 |
| $CCl_2 = CCl_2$ | 180 | 0.21 | 0.69 | 0.86 | 0.85 |
| Air | 180 | 0.04 | 0.77 | 0.93 | 0.86 |
| $F(CF(CF_3)CF_2O)_3CHFCF_3$ | 160 | 0.74 | 0.77 | 0.83 | 0.81 |
| $CCl_2 = CCl_2$ | 160 | 0.16 | 0.27 | 0.84 | 0.79 |
| Air | 160 | 0.03 | 0.25 | 0.79 | 0.74 |

As is seen, the fluorocarbon of the invention is consistently superior at the shorter exposure times, thus permitting rapid throughput, a desirable commercial feature.

Immersion in fluorocarbon liquids which are operable herein is equivalent to exposure to vapors of the fluorocarbon at the same temperature.

I claim:

1. Non-aqueous process for improving a functional property of natural and synthetic, organic, polymeric flexible substrates by applying thereto a non-dye agent which is capable of imparting the desired improved functional property to the substrate, which process comprises:

a. applying said agent to the substrate from a liquid medium;

b. optionally, drying the substrate to remove the liquid while substantially retaining the agent on the substrate; and c. contacting the agent-treated substrate with a fluorocarbon fluid at a temperature and for a time sufficient to effect fixation of the agent on the substrate, said fluorocarbon having an atmospheric pressure boiling point of at least 25° C., a fluorine to carbon atom ratio of at least 1.5 and a solubility parameter of not greater than 7.0 and being selected from the group consisting of saturated fluorocarbons and perfluorotrialkyl and perfluorotetraalkyl ethylenes.

2. Process of claim 1 wherein the substrate is a polymer having a glass transition temperature and heating is carried out above the glass transition temperature.

3. Process of claim 2 wherein the polymer is a nylon.

4. Process of claim 2 wherein the polymer is a polyester.

5. Process of claim 4 wherein the polyester is a polyethylene terephthalate.

6. Process of claim 1 wherein the solubility parameter is less than 6.5.

7. Process of claim 6 wherein the fluorocarbon is a perfluoroalkane of 9 to 16 carbon atoms.

8. Process of claim 6 wherein the fluorocarbon is of the formula $F[CF(CF_3)CF_2O]_nCF_2CF_3$ wherein $n$ is at least 3.

9. Process of claim 6 wherein the saturated fluorocarbon is of the formula $F[CF(CF_3)CF_2O]_nCHFCF_3$ wherein $n$ is at least 3.

10. Process of claim 9 wherein $n$ is 3–9.

11. Process of claim 6 wherein the fluorocarbon is perfluorotributylamine.

12. Process of claim 1 wherein the agent-treated substrate is dried before being contacted with fluorocarbon fluid.

13. Process of claim 1 wherein the agent-treated substrate is heat set.

14. Process of claim 1 wherein the agent is an ultraviolet light screen.

15. Process of claim 1 wherein the agent is a bacteriostat.

16. Process of claim 1 wherein the agent is a flame retardant.

17. Process of claim 1 wherein the agent is a durable press finish.

18. Process of claim 1 wherein the substrate is cotton.

19. Process of claim 1 wherein the fluorocarbon has a boiling point of at least 125° C.

* * * * *